United States Patent [19]

Reed, Jr. et al.

[11] Patent Number: 5,061,329

[45] Date of Patent: Oct. 29, 1991

[54] HIGH NITROGEN SMOKE COMPOSITIONS

[75] Inventors: Russell Reed, Jr.; May L. Chan, both of Ridgecrest, Calif.

[73] Assignee: The United States of America as represented by the Secretary of the Navy, Washington, D.C.

[21] Appl. No.: 404,677

[22] Filed: Aug. 3, 1982

[51] Int. Cl.[5] ..... C06B 45/00

[52] U.S. Cl. ..... 149/2; 149/19.6; 149/81; 149/84; 149/92; 149/109.4

[58] Field of Search ..... 149/2, 19.6, 92, 109.4, 149/84, 81

[56] References Cited

U.S. PATENT DOCUMENTS 2,995,526 8/1961 DeMent ..... 252/305
3,909,322 9/1975 Chang et al. ..... 149/19.6
4,288,262 9/1981 Flanagan et al. ..... 149/19.6
4,369,079 1/1983 Shaw ..... 149/45 X
4,370,181 1/1983 Lundstrom et al. ..... 149/109.4 X

*Primary Examiner*—Stephen J. Lechert, Jr.
*Attorney, Agent, or Firm*—Melvin J. Sliwka; Stuart Nissim

[57] ABSTRACT

High nitrogen smoke compositions capable of rapid dispersion of smoke dyes and capable of low temperature deflagration. Some compositions are capable of flameless deflagration in air. Compositions include pressed mixtures of 5,5'-bitetrazole and smoke dyes such as red, green, or yellow dyes. Other compositions include cast cured mixtures of azido binders such as glycidyl azide polymer and dyes, some of these compositions also including 5,5'-biterazole or an ammonium salt of 5-nitraminotetrazole.

22 Claims, No Drawings

HIGH NITROGEN SMOKE COMPOSITIONS

BACKGROUND OF THE INVENTION

1. Field of the Invention

The present invention relates to the field of chemistry. More particularly, the present invention relates to the field of smoke compositions for use in marking, signaling, and obscuring.

2. Description of the Prior Art

Prior smoke compositions suffer from low burning rates, thus yielding insufficient amounts of smoke in limited time intervals. These smoke compositions are thus deficient in providing smoke for tracking spinning aircraft where high rates of smoke generation are required Typical prior art smoke compositions include a dye, an oxidizer, such as $KClO_3$, and a binder such as sugar or polysulfide The binder-$KClO_3$ burned yielding heat which turned the dye into a gaseous state. The gaseous dye then cooled forming the cloud of solid dye particles. This process is inefficient since pyrolyis and oxidation of the dye takes place during the heating stage due to inherently high temperatures produced. These compositions, due to the presence of oxidizers such as $KClO_3$ are hazardous to process since they are friction sensitive. Further, these compositions have a tendency to flame in air producing no dye smoke color. In order to use these prior art smoke compositions, then, they must be enclosed in a cannister with a smoke outlet such as a nozzle to avoid contact with air during deflagration.

SUMMARY OF THE INVENTION

An object of the present invention is to provide smoke generating compositions having a high rate of smoke production.

A further object of the present invention is to provide smoke generating compositions capable of flameless deflagration in air.

A still further object of the present invention is to provide smoke generating compositions capable of burning at relatively low temperatures so a to minimize decomposition of coloring dyes, thus resulting in intensely colored smoke.

A still further object of the present invention is to provide smoke generating bombs having a high rate of smoke production and capable of flameless deflagration in air.

These objects and others are demonstrated by the present inventive compositions comprising high nitrogen compounds and smoke dyes. The present invention employs high nitrogen compounds which when ignited give off nitrogen and heat. Dyes, mixed with the high nitrogen compounds, are vaporized by the heat and dispersed due to developed nitrogen and subsequently condense as submicron particles, thus, producing a dyed smoke. Examples of high nitrogen compounds are (bitetrazole, and glycidyl azide polymer (GAP). Examples of dyes employed are smoke yellow number 7 smoke green, and smoke red. The smoke compositions using bitetrazole and dye are normally powdered mixtures which are pressed into shape. The smoke compositions using GAP and dye are cast cured. The inventive compositions deflagrate in air, burning at relatively low temperatures at a high burn rate while evolving nitrogen gas resulting in rapid release of relatively greater amounts of dye than prior art smoke compositions.

DESCRIPTION OF THE PREFERRED EMBODIMENTS

The smoke compositions of the present invention include various high nitrogen deflagrants and mixtures thereof. Use of 5,5'-bitetrazole provides a composition which can be deflagrate in open air. An effective alternative to 5,5'-bitetrazole is the ammonium salt of 5-nitraminotetrazole (ANT). The use of sufficient proportions of 5,5'-bitetrazole or ANT with azido binders in cast cured smoke compositions provides for effective deflagration in open air. Use of only azido binders as deflagrants results in useful smoke compositions but they must be deflagrated in a nozzled container to avoid flaming and are thus not suitable for use in open air. Azido binders useful for the smoke compositions of the present invention are glycidyl azide polymer (GAP), a copolymer of bis(azidomethyl)oxetane and tetrahydrofuran (BAMO/THF), a copolymer of bis(azidomethyl-)oxetane and azidomethyloxetane (BAMO/AMMO), a copolymer of bis(azidomethyl)oxetane and 3-azidooxetane (BAMO/AZOX), and 3-azidooxetane polymer (AZOX).

A great variety of smoke dyes are useful in the present invention, those employed in the examples below including smoke yellow number 7, smoke red, and smoke green. Orange smoke was obtained by the use of an in situ dye smoke resulting from reaction of lueco quinizarin (LQ) and ammonium iodate ($NH_4IO_3$) during the deflagration process. The smoke red dye, known as disperse red number 9, has a chemical name of 1-methylaminoanthraquinone. The smoke, green dye has a chemical name of 1,4-diparatoluidinoanthraguinone. The smoke yellow number 7 has a chemical name of 1,9-benz-10-anthrone. A useful alternative to smoke yellow number 7 is smoke yellow number 4, having a chemical name of 3,4,8,9-dibenzpyrene-5,10-quinone.

Preferred embodiments of smoke compositions are further illustrated by the preparation of smoke bombs according to the following examples presented below.

GAP 42.6
N-100 7.4
DIBUTYLTIN DILAURATE(T012) 0.005
DYE 50.0

Heated for 24 hours at 120–135° F. to complete the curing.

EXAMPLE I

Pressed samples of 50 percent by weight 5,5'-bitetrazole and 50 percent by weight of dye were prepared. Samples prepared included yellow, red, and green dyes, respectively, and were in the form of pressed cakes. Deflagration of each sample was initiated by an electrically heated wire in open air. Each sample deflagrated at a high rate without flaming and produced a brightly colored smoke.

EXAMPLE II

Mixtures of about 50 percent by weight GAP prepolymer mix and 50 percent by weight dye were prepared and cast cured to form smoke composition samples. Samples were prepared using green, red, and yellow dyes, respectively, and were in the form of cast cured cakes. The samples were contained in nozzled containers and deflagration was initiated by an electrically heated wire. Each sample deflagrated at a high rate without flaming and produced a brightly colored smoke.

The preferred proportions of GAP prepolymer mix to dye vary within the range of from about 50 percent to about 60 percent GAP and about 50 percent to about 40 percent dye by weight, respectively. Compositions having greater than 50 percent dye tended to be stiff pastes and were difficult to mix and cast; and compositions having less than 40 percent dye tend to produce inefficient smoke.

EXAMPLE III

Mixtures of 35 percent GAP prepolymer mix 15 percent ANT, and 50 percent dye by weight were prepared and cast cured to form smoke composition samples. Samples prepared included yellow, red, and green dyes, respectively. Deflagration of each sample was initiated by an electrically heated wire in open air. Each sample deflagrated at a high rate without flaming and produced a brightly colored smoke.

EXAMPLE IV

Mixtures of 50 percent GAP prepolymer mix 15 percent ANT, and 35 percent dye by weight were prepared and cast cured to form smoke composition samples. Samples prepared included yellow, red, and green dyes, respectively. Deflagration of each sample was initiated by an electrically heated wire in open air. Each sample deflagrated at a high rate without flaming and produced a brightly colored smoke.

The examples III and IV illustrated the preferred limits of compositions of the GAP-ANT-dye smoke compositions, GAP prepolymer mix in amounts less than 35 percent by weight being difficult to mix and cast compositions having less than 35 percent by weight of dye resulting in inefficient production of smoke. The amount of ANT can be varied from about 15 to about 20 percent by weight of the composition. The composition of Example IV is preferred to that of Example III for reasons of ease in processing the mixtures. An alternative smoke composition to that of examples III and IV employs 5,5'-bitetrazole rather than ANT with GAP prepolymer mix in the range of 35 to 50 percent and 5,5'-bitetrazole in the range of 15 to 20 percent by weight with the balance being the desired dye.

The acidity of the 5,5'-bitetrazole causes gas evolution during the curing which results in some porosity in the smoke grains. This effect is not necessarily undesirable since it may tend to increase the rate of deflagration.

EXAMPLE V

A mixture of about 25 percent GAP prepolymer mix, 40 percent $NH_4IO_3$, and 35 percent LQ by weight was prepared and cast cured to form a smoke composition sample. Deflagration of the sample was initiated by an electrically heated wire in open air. The sample deflagrated at a high rate without flaming and produced large amounts of an orange colored smoke.

The preferred proportions GAP prepolymer mix, $NH_4IO_3$, and LQ can vary within the range of from about 25 percent to about 35 percent by weight GAP prepolymer, about 40 percent to about 50 percent by weight $NH_4IO_3$, and about 25 percent to about 35 percent LQ. It is suggested that the relatively higher proportion of LQ result in more easily processed mixes.

It is to be understood that what has been described is merely illustrative of the principles of the invention and that many variations in accordance with this invention may be devised by one skilled in the art without departing from the spirit and scope thereof.

We claim:

1. A high nitrogen smoke composition comprising a mixture of 5,5' bitetrazole and a smoke dye.

2. The composition of claim 1 wherein said composition comprises about 50 percent by weight 5,5'-bitetrazole.

3. A high nitrogen smoke composition comprising a cured mixture, said mixture comprising an azido binder and a smoke dye.

4. A high nitrogen smoke composition according to claim 3 wherein said mixture comprises from about 50 to 60 percent by weight azido binder and from about 40 to about 50 percent by weight of smoke dye.

5. A high nitrogen smoke composition comprising a cured mixture, said mixture comprising an azido binder, a smoke dye, and an element selected from the group consisting of the ammonium salt of 5-nitraminotetrazole and 5,5'-bitetrazole.

6. A high nitrogen smoke composition according to claim 5 wherein said mixture comprises from about 35 to about 50 percent by weight azido binder.

7. A high nitrogen smoke composition according to claim 6 wherein said mixture comprises from about 15 to about 20 percent by weight of said selected element.

8. A high nitrogen smoke composition comprising a cured mixture, said mixture comprising an azido binder, ammonium iodate, and luecoquinizarin.

9. A high nitrogen smoke composition according to claim 8 wherein said mixture comprises from about 25 to about 35 percent by weight azido binder.

10. The high nitrogen smoke composition of claim 9 wherein said mixture comprises from about 25 percent to about 35 percent by weight luecoquinizarin.

11. The high nitrogen smoke composition according to claims 3, 5 or 8 wherein said azido binder is selected from the group consisting of a glycidyl azide polymer, a copolymer of bis(azidomethyl)oxetane and tetrahydrofuran, a copolymer of bis (azidomethyl)oxetane and azidomethyloxetane, a copolymer of bis(azidomethyl-)oxetane and 3-azidooxetane, and 3-azidooxetane polymer binders.

12. The high nitrogen smoke composition according to claims 1, 3 or 5 wherein said smoke dye is selected from the group consisting of 1-methylaminoanthraquinone, 1,4-diparatoluidinoanthraquinone, 1,9-benz-10-anthrone and 3,4,8,9-dibenzpyrene-5,10-quinone.

13. A high nitrogen smoke bomb capable of flameless deflagration in air comprising a pressed cake of a mixture comprising 5,5'-bitetrazole and a smoke dye.

14. The high nitrogen smoke bomb of claim 13 wherein said mixture comprises about 50 percent by weight 5,5'-bitetrazole.

15. A high nitrogen smoke bomb capable of flameless deflagration in air comprising a cast cured cake of a mixture, said mixture comprising an azido binder, a smoke dye, and an element selected from the group consisting of the ammonium salt of 5-nitraminotetrazole and 5,5'-bitetrazole.

16. The high nitrogen smoke bomb of claim 15 wherein said mixture comprises about 35 to about 50 percent by weight azido binder.

17. The high nitrogen smoke bomb of claim 16 wherein said mixture comprises about 15 to about 20 percent by weight of said selected element.

18. A high nitrogen smoke bomb capable of flameless deflagration in air comprising a cast cured cake of a mixture, said mixture comprising an azido binder, ammonium iodate and luecoquinizarin.

19. The high nitrogen smoke bomb of claim 18 wherein said mixture comprises from about 25 to about 35 percent by weight azido binder.

20. The high nitrogen smoke bomb of claim 19 wherein said mixture comprises from about 25 percent to about 35 percent by weight luecoquinizarin.

21. The high nitrogen smoke bomb of claims 15 or 18 wherein said azido binder is selected from the group consisting of glycidyl azide polymer, a copolymer of bis(azidomethyl)oxetane and tetrahydrofuran, a copolymer of bis(azidomethyl)oxetane and azidomethyloxetane, a copolymer of bis(azidomethyl)oxetane and 3-azidooxetane, and 3-azidooxetane polymer.

22. The high nitrogen smoke bomb of claims 13 or 15 wherein said smoke dye is selected from the group consisting of 1-methylaminoanthraquinone, 1,4-diparatoluidinoanthraquinone, 1,9-benz-10-anthrone and 3,4,8,9-dibenzpyrene-5,10-quinone.

* * * * *